US007918048B2

(12) United States Patent
Austin

(10) Patent No.: US 7,918,048 B2
(45) Date of Patent: Apr. 5, 2011

(54) MOON CLIP SERVER

(76) Inventor: James Allen Austin, Fox Island, WA (US)

( * ) Notice: Subject to any disclaimer, the term of this patent is extended or adjusted under 35 U.S.C. 154(b) by 359 days.

(21) Appl. No.: 12/049,301

(22) Filed: Mar. 15, 2008

(65) Prior Publication Data

US 2009/0229161 A1 Sep. 17, 2009

(51) Int. Cl.
*F41A 9/82* (2006.01)

(52) U.S. Cl. ..... 42/89; 42/88; 221/279

(58) Field of Classification Search ..... 42/87–89; 89/33.1, 33.5, 34; 221/56–59, 279, 280
See application file for complete search history.

(56) References Cited

U.S. PATENT DOCUMENTS 202,613 A * 4/1878 White ..... 42/87
354,454 A * 12/1886 Wesson ..... 42/89
1,175,907 A * 3/1916 Slade ..... 221/185
2,902,196 A * 9/1959 Gray ..... 221/268
3,248,007 A * 4/1966 Hulterstrum ..... 221/116
3,283,954 A * 11/1966 Spooner ..... 221/232
3,769,733 A * 11/1973 Nelson ..... 42/89
4,272,903 A * 6/1981 Griffis ..... 42/89
4,381,845 A * 5/1983 Feis ..... 221/185
5,548,916 A * 8/1996 Kinsel et al. ..... 42/89
6,688,504 B1 * 2/2004 Kirkaldy ..... 224/196
6,817,135 B1 * 11/2004 Jackson ..... 42/87

* cited by examiner

*Primary Examiner* — Michael Carone
*Assistant Examiner* — Gabriel J Klein

(57) ABSTRACT

A revolver cartridge assembly storing device, that sequentially delivers cartridge assemblies to a consistent point for extraction. The device consists of a guide rail suspended by its ends on a mainframe which is mounted to a user's torso. The cartridge assemblies sit on said guide rail where they are propelled by a means of force to either a left or right extraction point. There they may be freely retrieved to augment the reloading of the revolver.

14 Claims, 7 Drawing Sheets

MOON CLIP SERVER

BACKGROUND OF THE INVENTION

The present invention relates to an ammunition assembly carrier that provides storage and quick and easy access of cartridge assemblies for the reloading of revolver type firearms.

A number of devices and methods have been proposed for such assembly carriers. None of these, however, have addressed the need for cartridge storage offering quick and easy access of cartridges to the user.

The need for a method to quickly reload a firearm with a revolving cylinder has been made known in the prior art. U.S. Pat. No. 201,855, U.S. Pat. No. 202,613 and U.S. Pat. No. 5,548,916 all teach methods in which multiple firearms cartridges are stored in a carrier designed to reload a revolving cylinder. These methods generally describe a series of connected tubes that hold groups of individual cartridges in a configuration so that when the carrier is mated with a revolving cylinder, the individual cartridges are released therein.

Also known are the methods of carrying reloading cartridge packs as taught by U.S. Pat. Nos. 354,454 and 4,408,707, which demonstrate carrying individual reloading cartridge packs on a belt for easy access when reloading.

Also known is the method of carrying cartridge packs as taught in U.S. Pat. No. 6,688,504 in which cartridge packs are carried in a cylindrical body with a release mechanism to retrieve cartridge packs. While these devices fulfill their respective objectives and requirements, the need remains for a device that further advances the afore described art by providing a single device that carries multiple cartridge assemblies so the user can visually see the cartridge assembly, reach for it precisely at one point and retrieve it without manipulating a release mechanism.

SUMMARY OF THE INVENTION

It is therefore the object of this invention to provide a device that carries multiple cartridge assemblies for a revolver type firearm, which can be carried on a person's belt. This device is capable of sequentially delivering a cartridge assembly to a predetermined location and allowing said cartridge assembly to be retrieved from said device without manipulating any release mechanism.

In general the invention includes a mainframe, a holding and guiding rail on which the cartridge assemblies are inserted, and a spring to push said cartridge assemblies to the left or the right side. At the left or right side, a bulkhead prevents the cartridges from sliding off the end of said rail and offers a left or a right location in which to load and retrieve cartridge assemblies from the present invention.

The more important features of the invention, rather broadly outlined in the detailed description that follows, are presented in order that the invention may be better understood and in order that the present contribution to the art may be better appreciated. Addition features of the invention will be described hereinafter which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will become more apparent by reading the following detailed description in conjunction with the drawings, which are shown by way of example only, wherein.

DESCRIPTION OF THE PREFERRED EMBODIMENT

Figure 1:
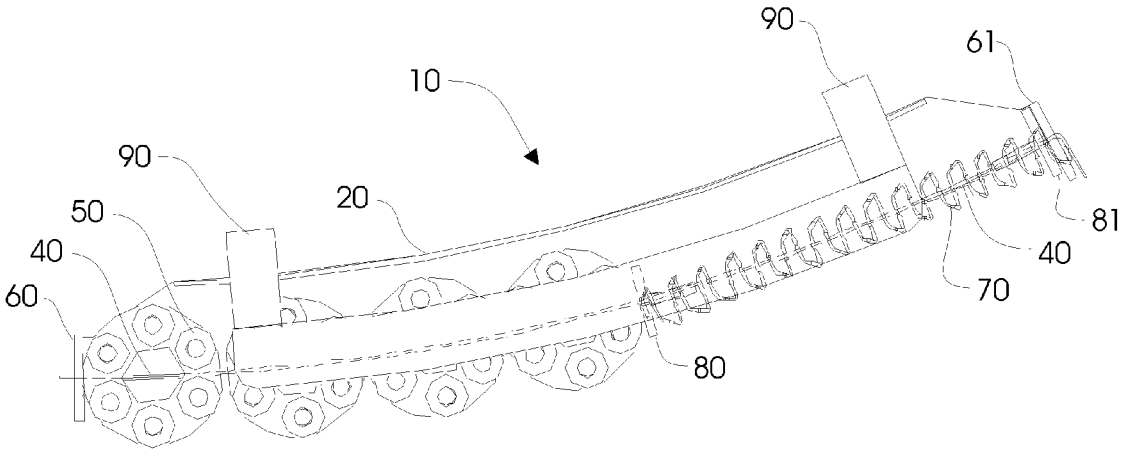
FIG. 1 is a top view of the present invention.

With reference to the drawings in FIGS. 1 through 8, a new cartridge assembly server device embodying the principals and concepts of the present invention and generally designated by the numeral 10 will be described.

Herein is described a reloading cartridge server 10 comprising a mainframe 20 in which cartridges assemblies 50 may be installed such as the cartridge referred to as a moon clip 50 and an odd number of cartridges 51. Also described is a reloading cartridge server for holding a speed loader type cartridge assembly 52 used in a firearm called a speed loader.

Figure 3:
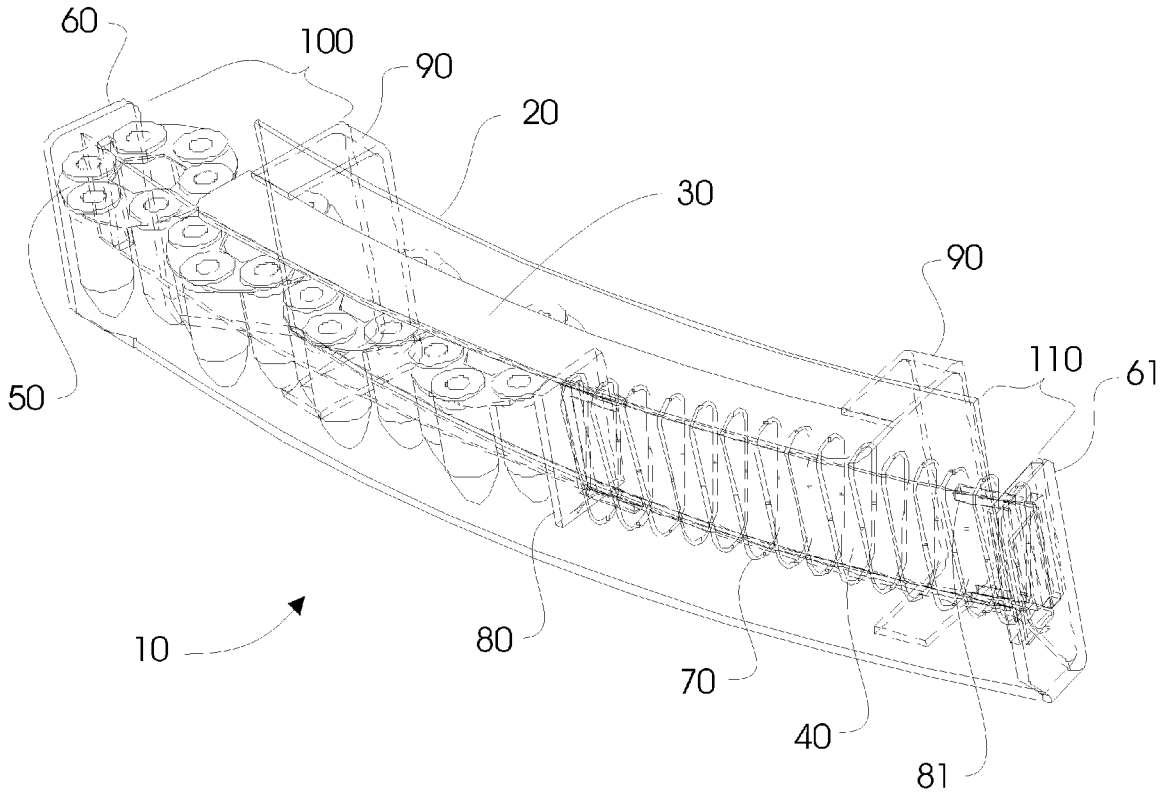
FIG. 3 is a perspective view from above the present invention.
Figure 4:
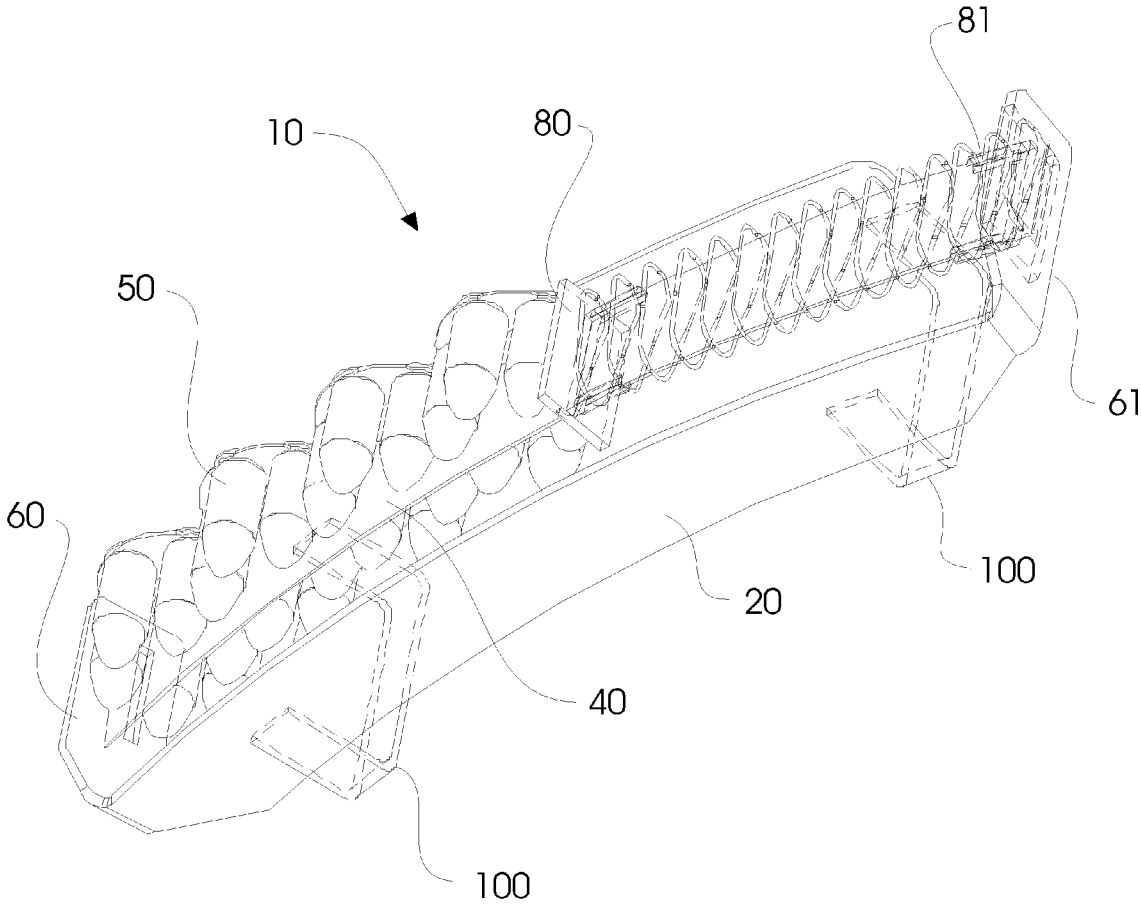
FIG. 4 is a perspective view from below the present invention.

As best illustrated in FIG. 1 the cartridge assembly server 10 generally comprises a mainframe 20 that has an arched shape to match that of the torso of an average person. As a belt-mounted device, server 10, as shown in FIGS. 1 and 3, may be mounted on the left side of the user's torso and the cartridge assemblies 50 accessed with the right hand. Similarly, server 10 may be mounted on the right side of the user's torso and the cartridge assemblies 50 accessed with the left hand.

As viewed in FIGS. 1 and 3, right bulkhead 60 and left bulkhead 61 are rigidly attached to and protrude out from each end of the mainframe 20. The distance from the right bulkhead 60 to the left bulkhead 61 would be defined by the number of cartridge assemblies 50 to be carried. In FIG. 1, left finger area 110 defines the space between the left bulkhead 61 and the mainframe 20 and right finger area 100 defines the space between the right bulkhead 60 and the mainframe 20. These spaces, 100 and 110 allow finger access for retrieving cartridge assemblies 50.

As viewed in FIGS. 1 and 3, rail 40, is formed so as to follow the arch as set forth by the mainframe 20 and is suspended by its ends to the mainframe 20 via the right bulkhead 60 and left bulkhead 61, at a distance away from the mainframe 20 sufficient to permit room between the cartridge assemblies 50 and mainframe 20.

As viewed in FIG. 1, FIG. 3, FIG. 4 and FIG. 6, the cartridge assemblies rest centered on the rail 40 with odd numbered cartridge assemblies 51 centered as much as possible.

Figure 2:
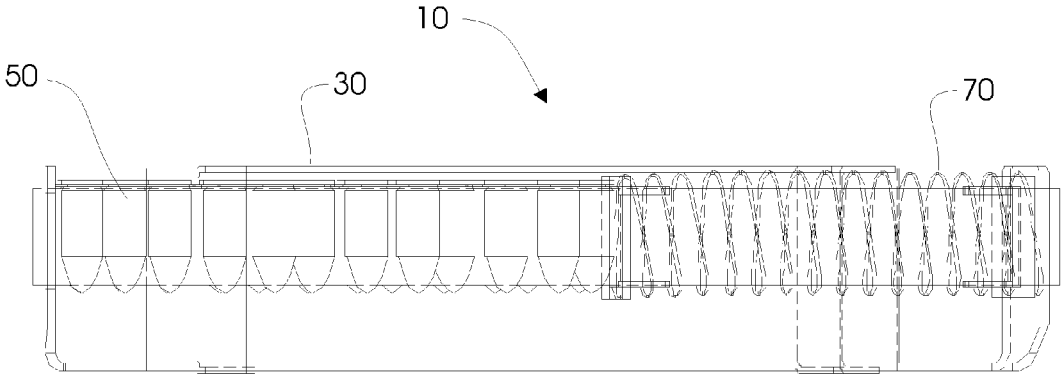
FIG. 2 is a side view of the present invention.
Figure 5:
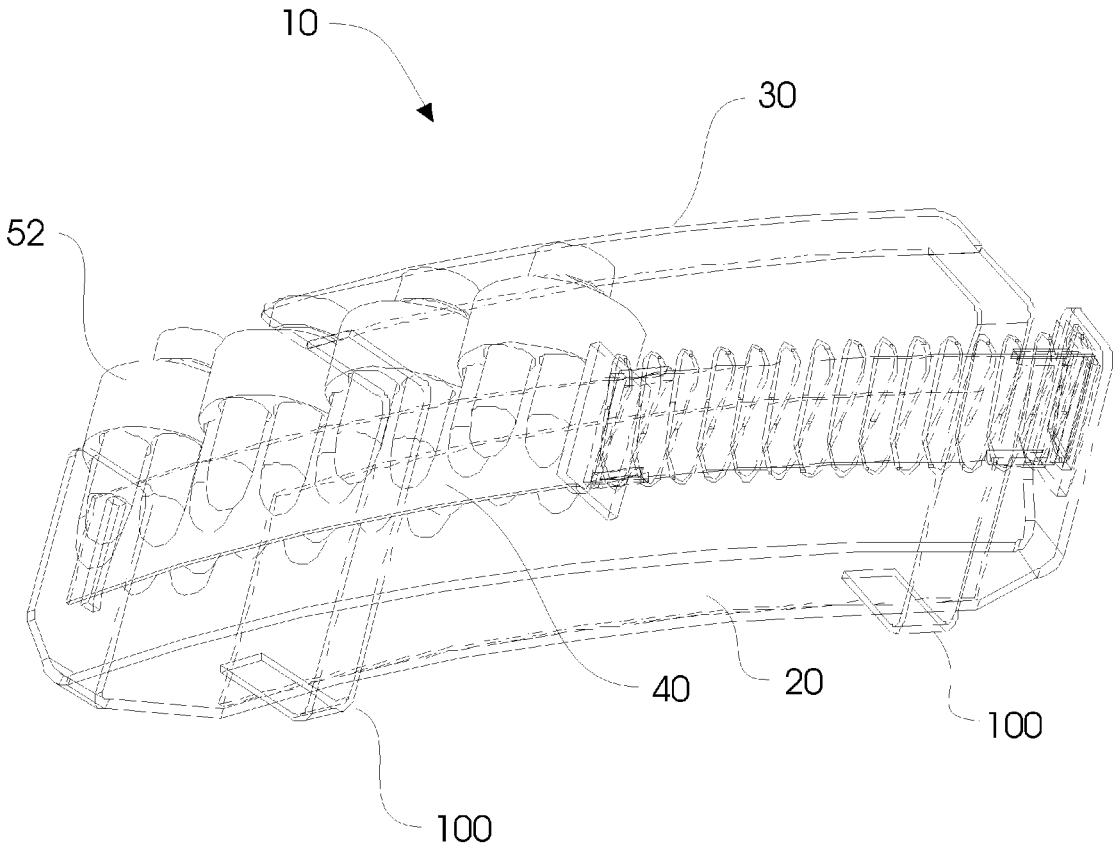
FIG. 5 is a perspective view from below the present invention showing a speed load-type cartridge assembly.
Figure 6:
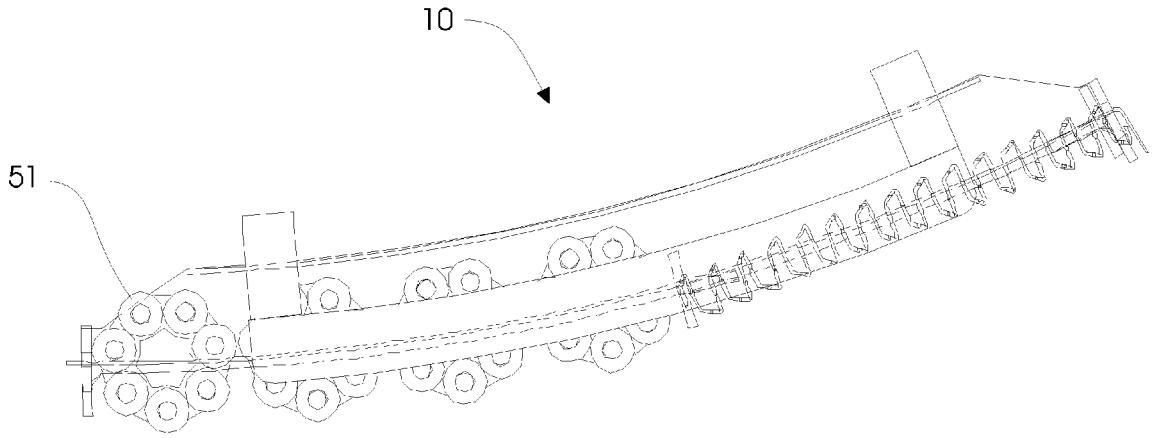
FIG. 6 is a top view of the present invention showing the cartridge assembly holding an odd number of cartridges.

As viewed in FIGS. 2, 3 and 5 top plate 30 attaches to the mainframe 20 above the rail 40 and protrudes away from the mainframe 20 to prevent cartridge assemblies 50 from vertically sliding off the rail 40. The distance the top plate 30 is mounted above the rail 40 is set by the type of cartridge assembly to be used. As viewed in FIG. 2, a moon clip type cartridge assembly 50 is shown. As viewed in FIG. 5, a speed loader type cartridge assembly 52 is shown. Top plate 30 may be attached to the mainframe 20 in an adjustable manor so that the height of cartridge assemblies 50, 51, and 52 are accommodated.

As viewed in FIGS. 1 and 3, a propelling spring 70, a right spring follower 80, and a left spring follower 81, fit around the rail 40 and serve to push the cartridge assemblies 50 toward the right bulkhead 60 or the left bulkhead 61, depending on which end the cartridge assemblies 50 are installed. It is also understood that spring 70 and the followers 80 and 81 provide enough tension on the cartridge assemblies 50 to detent said cartridge assemblies against the left or the right bulkheads 60 and 61 to prevent unwanted extraction caused by running or jumping of the user.

Also viewed in FIGS. 1 and 3 is a cartridge assembly server 10 that is assembled to accommodate the user wearing it on the left side of the torso. The server 10, being symmetrical in shape, allows spring 70 and right and left spring followers 80 and 81 to be slid along rail 40 to the opposite end of mainframe 20 so as to allow cartridges 50 to be loaded from the opposite end of mainframe 20 and thus, accommodate the user wearing it on the right side of the torso.

Although not depicted, the spring followers 80 and 81 may have a handle protruding out beyond the cartridge assemblies to aid in loading the cartridge assembly server 10.

Figure 7:
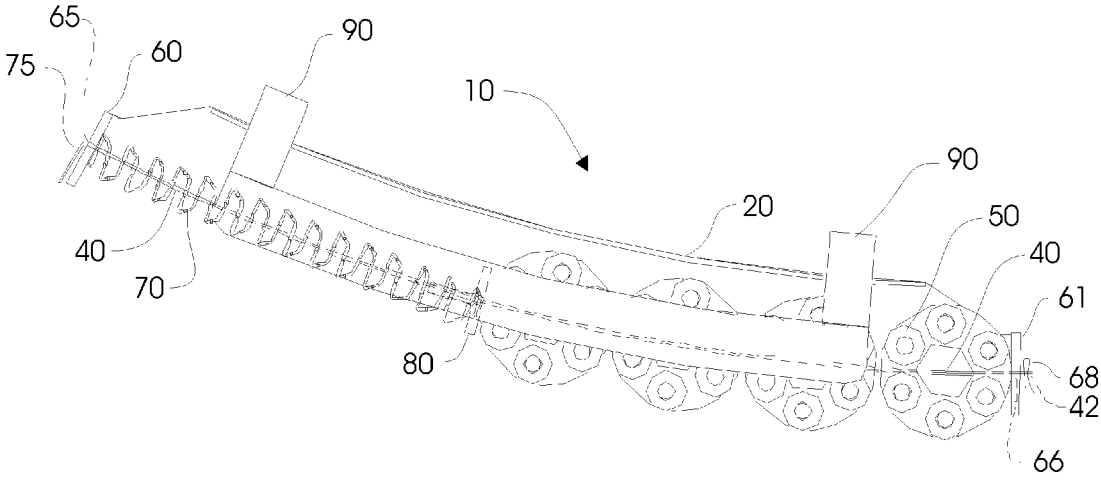
FIG. 7 is a top view of the present invention showing the cartridge assemblies installed at the opposite end of the cartridge server and showing a removable rail.
Figure 8:
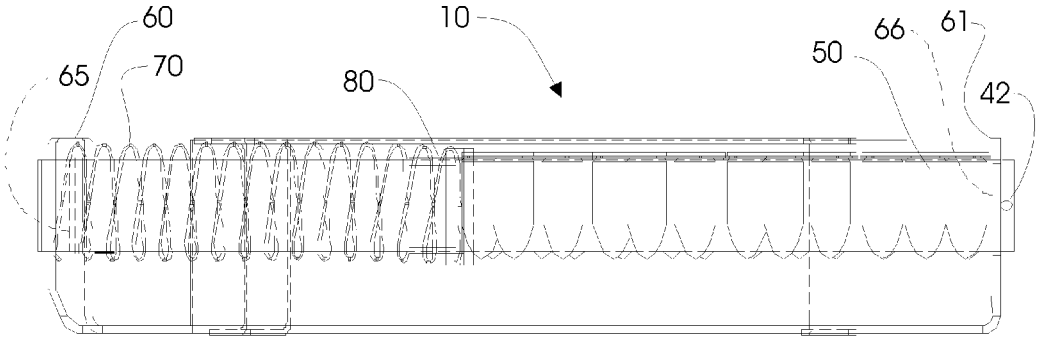
FIG. 8 is a side view of FIG. 7.

As viewed in FIGS. 7 and 8, another embodiment of server 10 is shown wherein rail 40 may be formed with means to be removable, thus, providing means to easily replace spring 70 and also providing means to install the cartridge assemblies 50 on the opposite end of server 10. Rail 40, as shown in FIGS. 7 and 8 is removable through bulkhead slot 65 in bulkhead 60 and bulkhead slot 66 in bulkhead 61. Once reinstalled, rail 40 is secured at one end to bulkhead 61 by way of pin hole 42 in the end of rail 40 where a cotter pin 68 or other securement means, is inserted to secure rail 40 within slot 66. At the opposite end of rail 40, a bend 75 (about 90 degrees) is formed so as to secure the rail 40 within slot 65 of bulkhead 60 and render the end of rail 40 un-obstructive to the user.

Whereas the above description discloses one method of providing a removable rail 40, other methods may be employed that would accomplish the same goal.

In addition, the embodiment of server 10, as shown in FIGS. 7 and 8, eliminates the need for the installation of left spring follower 81.

As viewed in FIGS. 1 and 3, belt loop 90, one formed at each end of server 10, is attached to the back of mainframe 20.

Figure 9:
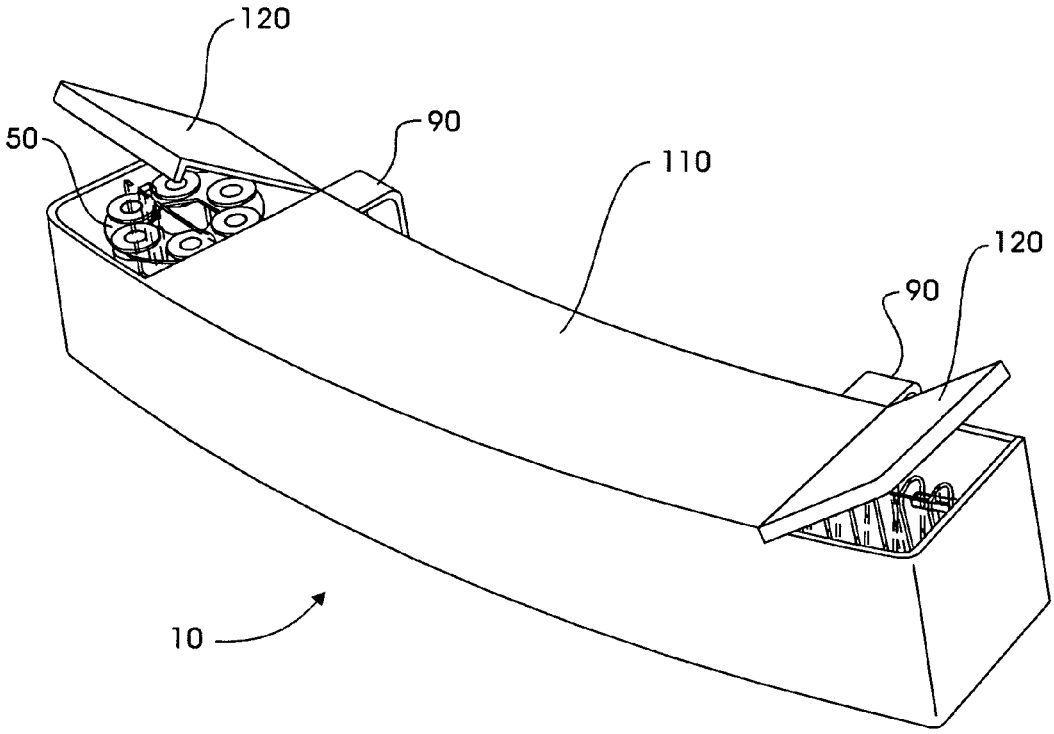
FIG. 9 is a view of FIG. 3 depicting a surrounding covering and hatches.

As viewed in FIG. 9 the cartridge assembly server 10 may have a covering, said covering having hatches over 100 right finger area and 101 left finger area.

REFERENCE NUMERALS IN THE DRAWING

10 cartridge assembly server
20 main frame
30 top plate
40 rail
42 hole
50 cartridge assembly, moon clip
51 cartridge assembly, odd number of cartridges
52 cartridge assembly, speed loader type
60 right bulkhead
61 left bulkhead
65 bulkhead slot
66 bulkhead slot
68 pin
70 propelling spring
75 bend
80 right spring follower
81 left spring follower
90 belt loops
100 right finger area
101 left finger area
110 surrounding cover
120 hatches

What is claimed is:

1. A device for delivering cartridge assemblies to a user comprising:

(a) a rail for holding and guiding cartridge assemblies, said rail having a left end and a right end;

(b) a propelling spring with a first follower attached to a first end of said propelling spring and a second follower attached to a second end of said propelling spring; said propelling spring, said first follower, and said second follower each circumscribing said rail;

(c) a left bulkhead attached to the left end of said rail and a right bulkhead attached to the right end of said rail, the left and right bulkheads holding said rail suspended away from a mainframe, and (d) said left and right bulkheads attached to said mainframe a distance apart equal to the length of said rail;

(e) a top plate attached to said mainframe over said rail, said top plate being shorter in length then the distance between said left and right bulkheads and permitting retrieval of cartridge assemblies at either said left or said right bulkhead; and (f) said mainframe having a mounting apparatus for mounting the device on a user's belt.

2. The device of claim 1 wherein cartridge assemblies straddle the rail.

3. The device of claim 1 wherein the propelling spring is mounted independent of the rail.

4. The device of claim 1 wherein the bulkheads have a leaning angle towards the center of the mainframe to help retain the cartridge assemblies.

5. The device of claim 1 further including a surrounding covering and openable hatches adjacent the left and right bulkheads to conceal the cartridge assemblies.

6. The device of claim 1 wherein the height of top plate is adjustable to accommodate variable heights of said cartridge assemblies.

7. The device of claim 1 wherein said rail is removable and re-securable and wherein said propelling spring and at least one follower are reversible.

8. A device for securely carrying and sequentially delivering cartridge assemblies to a specific location comprising:

(a) a mainframe having a left bulkhead and a right bulkhead protruding outward from a left end and a right end of the mainframe respectively, the left bulkhead and the right bulkhead being separated from one another by a first distance; and (b) a rail suspended from said left bulkhead and said right bulkhead for holding and guiding cartridge assemblies;

(c) a spring circumscribing said rail to propel cartridge assembles towards said left or right bulkheads;

(d) a first follower circumscribing said rail at a first end of said spring and a second follower circumscribing said rail at a second end of said spring; and (e) a top plate over said rail attached to said mainframe and extending a distance less than the first distance to allow said cartridge assemblies to be inserted and withdrawn from said device at either of said left or right bulkheads.

9. The device of claim 8 further including a cartridge assembly concealing cover having openable hatches positioned adjacent the left and right bulkheads to selectively allow withdrawal of cartridge assemblies.

10. The device of claim 8 wherein said spring is mounted in a selectively removable manner and independent of said rail.

11. The device of claim 8 wherein the mainframe is capable of being mounted on a person.

12. The device of claim 8 wherein the top plate is secured to said mainframe in a vertically adjustable manner.

13. The device of claim 8 wherein said spring and at least one of the first and second followers are reversible, and wherein said rail is selectively removable from the mainframe.

14. A device for delivering cartridge assemblies to a user comprising: (a) a rail for holding and guiding cartridge assemblies, said rail having a left end and a right end; (b) a propelling spring with a first follower attached to the left end of the propelling spring and a second follower attached to the right end of the propelling spring, said first and second followers each circumscribing said rail; (c) a left bulkhead attached to the left end of said rail and a right bulkhead attached to the right end of said rail, the left and right bulkheads holding said rail suspended away from a mainframe, and (d) said left and right bulkheads attached to said mainframe and separated by a distance equal to the length of said rail; (e) a top plate attached to said mainframe over said rail, said top plate being shorter in length than the distance between said left and right bulkheads and permitting retrieval of cartridge assemblies at either said left bulkhead or said right bulkhead; (f) said mainframe having a mounting apparatus for mounting the device on a user's belt; and (g) wherein said cartridge assemblies straddle said rail.

* * * * *